United States Patent [19]

Smith et al.

[11] Patent Number: 4,685,978

[45] **Date of Patent: * Aug. 11, 1987**

[54] HEAT TREATMENTS OF CONTROLLED EXPANSION ALLOY

[75] Inventors: John S. Smith, Proctorville, Ohio; Darrell F. Smith, Jr., Huntington, W. Va.

[73] Assignee: Huntington Alloys Inc., Huntington, W. Va.

[ * ] Notice: The portion of the term of this patent subsequent to Dec. 11, 2001 has been disclaimed.

[21] Appl. No.: 552,949

[22] Filed: Nov. 17, 1983

Related U.S. Application Data

[63] Continuation-in-part of Ser. No. 409,838, Aug. 20, 1982, Pat. No. 4,487,743.

[51] Int. Cl.[4] ..... C21D 6/02; C22F 1/10

[52] U.S. Cl. ..... 148/142; 148/158; 148/162; 148/328; 148/409; 148/419

[58] Field of Search ..... 148/162, 158, 142, 31, 148/409, 410, 419; 420/459, 460

[56] References Cited

U.S. PATENT DOCUMENTS

| | | | |
|---|---|---|---|
| 2,994,605 | 8/1961 | Gill et al. | 75/171 |
| 3,046,108 | 7/1962 | Eiselstein | 75/171 |
| 3,157,495 | 11/1964 | Eiselstein et al. | 75/134 |
| 3,705,827 | 12/1972 | Muzyka et al. | 148/142 |
| 3,971,677 | 7/1976 | Mason et al. | 148/31 |
| 3,972,752 | 8/1976 | Honnorat et al. | 148/162 |
| 4,006,011 | 2/1977 | Muzyka et al. | 75/122 |
| 4,026,699 | 5/1977 | Eiselstein et al. | 75/134 F |
| 4,066,447 | 1/1978 | Smith et al. | 75/122 |
| 4,200,459 | 4/1980 | Smith et al. | 75/170 |
| 4,445,943 | 5/1984 | Smith, Jr. et al. | 148/162 |
| 4,445,944 | 5/1984 | Smith, Jr. et al. | 148/162 |
| 4,487,743 | 12/1984 | Smith et al. | 420/459 |

FOREIGN PATENT DOCUMENTS

| | | |
|---|---|---|
| 056480 | 12/1981 | European Pat. Off. . |
| 2228117 | 10/1974 | France . |
| 2228118 | 10/1974 | France . |
| 2411246 | 6/1979 | France . |
| 2411896 | 6/1979 | France . |
| 999439 | 7/1965 | United Kingdom . |
| 997767 | 7/1965 | United Kingdom . |
| 1083432 | 9/1967 | United Kingdom . |
| 1411693 | 5/1974 | United Kingdom . |

*Primary Examiner*—R. Dean

*Attorney, Agent, or Firm*—Raymond J. Kenny; Francis J. Mulligan, Jr.

[57] ABSTRACT

Controlled low expansion alloys containing nickel, titanium, columbium, silicon, etc., and optionally cobalt can be heat treated using relatively short periods of time. Aging treatments can be less than eight hours, for example, four hours.

6 Claims, No Drawings

HEAT TREATMENTS OF CONTROLLED EXPANSION ALLOY

The present application is a continuation-in-part of our U.S. application Ser. No. 409,838 filed Aug. 20, 1982 U.S. Pat. No. 4487743 and is directed primarily to special heat treating processing in respect of certain nickel-iron and nickel-iron cobalt alloys as herein described.

BACKGROUND OF THE INVENTION

In our parent U.S. application Ser. No. 409,838 U.S. Pat. No. 4487743 controlled low expansion, nickel-iron and nickel-cobalt-iron alloys are described and claimed, the alloys being characterized by (i) an inflection temperature of at least 625° F., (ii) a coefficient of expansion between ambient and inflection temperature not greater than $5.5 \times 10^{-6}$ per ° F., (iii) high room temperature tensile strength, (iv) improved elevated temperature stress-rupture properties, including notch-rupture strength, (v) good notch ductility (notch bar rupture life exceeds smooth bar rupture life), etc.

The alloys as set forth in U.S. Ser. No. 409,838 U.S. Pat. No. 4487743 contain about 34% to 55% nickel, up to 25% cobalt, about 1% to 2% titanium, about 1.5% to 5.5% columbium, about 0.25% to 1% silicon, not more than about 0.2% aluminum, not more than about 0.1% carbon, with iron being essentially the balance. A more advantageous and preferred composition contains about 35% to 39% nickel, about 12% to 16% cobalt, about 1.2% to 1.8% titanium, about 4.3% to 5.2% columbium, about 0.3% to 0.5% silicon, not more than about 0.1% aluminum, not more than about 0.1% carbon, with iron again constituting essentially the balance.

A number of Heat Treatments as applied to the alloys above-described were also set forth as follows Heat Treatment "A": anneal at 1700° F./1hr; AC; age at 1325° F./8hr; FC to 1150° F. at 100° F./hr; age at 1150° F./8hr; AC Heat Treatment "B": same as "A" except anneal at 1800° F.

Heat Treatment "C": same as "A" except anneal at 1900° F.

Heat Treatment "D": same as "B" except first aging at 1425° F.

Heat Treatment "E": same as "C" except first aging at 1425° F.

Heat Treatment "F": same as "A" except first aging at 1425° F.

Heat Treatment "G": same as "A" except first cooling step is a WQ

Heat Treatment "H": same as "C" except first aging at 1425° F. for 24 hrs.

Note: AC=air cool; FC=furnace cool; WQ=water quench

The foregoing heat treatments utilized relatively extended periods of time. A basic purpose of the instant invention was to reduce processing time.

SUMMARY OF THE INVENTION

It has now been found that heat treating parameters can be applied to the subject alloys whereby shorter processing periods, if desired, can be utilized. This should lend to lower production costs. Moreover, it has been found that the aluminum level can be increased to about 1.25% without deleteriously adversely impacting coefficient of expansion and mechanical properties.

This lends to increased tensile and rupture properties. Furthermore, whereas it was considered that boron might not have been significantly beneficial, we have determined boron contributes to improved smooth bar rupture strength particularly at levels from about 0.003% to about 0.008%.

DESCRIPTION OF THE INVENTION

It has been determined that Inflection Temperature (IT) and Coefficient of Expansion (COE) can be approximated from composition using the following formulae:

$$COE = -8.698 - 1.888\,(\%C) + 0.367\,(\%Mn\%Cu) + 0.145(\%Si + \%Cr) - 0.2683\,(\%Ni) + 0.2481\,(\%\,Co) - 0.392(\%Ti).$$

$$IT = -804.4 + 306.7\,(\%C) - 39.8(\%Si + \%Cr) + 32.8\,(\%Ni) + 31.9(\%Co) - 37.8\,(\%Ti).$$

Thus to guarantee an IT of at least 625° F. and a COE no greater than $5.5 \times 10^{-6}$ per° F. measured at 780° F. from ambient temperature the composition of the alloys of the invention must be restricted by the following relationships:

$$A = (\%Ni) + 0.93(\%Co) - 1.46(\%Ti) + 0.54(\%Si + \%Cr) - 1.37\,(\%Mn - \%Cu) + 7.04\,(\%\,C)\ \text{At most } 52.9$$

$$B = (\%Ni) + 0.97\,(\%Co) - 1.15\,(\%Ti) - 1.21\,(\%\,Si\%\,Cr) 9.35\,(\%C) A \pm \text{least } 43.6.$$

Generally speaking and in accordance with the invention, nickel-iron and nickel-cobalt-iron alloys of the age-hardenable, controlled low expansion type and containing about 34 to 55% nickel, up to 25% cobalt, about 1% to about 2% titanium, about 1.5% to 5.5% columbium, about 0.25% to 1% silicon, up to about 1.25% aluminum, up to about 0.01% boron, up to about 0.1% carbon, the balance essentially iron, (i) are annealed over the range of 1750° F. to 1900° F. for a period of from 1 minute to 9 hours, depending upon section size, (ii) cooled to ambient temperature as by an air cool or water quench, (iii) aged to about 1300° F. to 1500° F. for about 1 or 2 hours to 12 hours, depending upon section size, (iv) air cooled to about 1100° F., (v) aged at about 1100° F. to about 1250° F. for up to 12 hours, and (vi) cooled to ambient temperature. Of course, the alloys of the more advantageous composition (35-39% Ni, 12-16% Co, 1.2-1.8% Ti, 4.3-5.2% Cb, 0.3-0.5% Si, up to 0.1% Al, up to 0.1% C, bal Fe) can be similarly treated.

ANNEALING TEMPERATURE

An annealing temperature as low as 1700° F. can be used and an excellent overall combination of tensile and rupture properties are obtained. However, annealing at this temperature level may not fully recrystallize the alloys (depending upon chemistry) or solutionize intermetallic phases, e.g., $Ni_3$ (Cb,Ti). This in turn could render the alloys unnecessarily sensitive to prior processing history. While as indicated supra an annealing temperature up to about 1900° F. can be utilized, the alloys tend to grain coarsen and this is usually accompanied by a fall-off in rupture properties. To offset this, overaging may be required. Accordingly, it is deemed advantageous to anneal at from 1750° F. or 1775° F. to 1825° F. or 1850° F.

The time at anneal is dependent upon thickness of the material aged. Thin sheet may require but a few minutes. Rod products on the other hand would require up to three (3) or four (4) hours. As a practical matter, an annealing period of up to six (6) hours or less will normally suffice, grain growth being a controlling factor.

INITIAL COOLING

Cooling rate can vary from a water quench to air cooling to a furnace cool. Cooling rate from the anneal can have a significant impact on mechanical properties developed upon aging. And this can require adjusting the aging parameters to compensate. For example, water quenching tends to cause overaging. Thus, aging at lower temperatures would be desirable. Slow cooling can also induce overaging, requiring similar precautions. Cooling rates of 50° F. to 300° F./hr are generally suitable. It might be added that cooling to ambient temperature prior to aging is deemed a normal procedure to follow although in some instances, e.g. when heat treating in atmosphere, the alloys may be cooled directly to the aging temperature.

INITIAL AGING

The first aging treatment should be conducted within the range of about 1300° F. to about 1450° F. for about 2 to 12 hrs. Temperatures above 1450° F., say 1475° F., and higher result in overaging with a concomitant loss in room temperature (RT) tensile strength and ductility and smooth bar rupture strengths; however, elevated temperature rupture ductility and notch strength increase. Based on data generated to date and using the notch strengths obtained from aging temperatures in the range of 1325° F. to 1350° F. for purposes of comparison, notch strength increased by an order of magnitude, i.e., from 97 hrs to 975 hrs at the 1475° F. age (test temperature 1000° F. with stress being 145 ksi). Thus, for applications geared to elevated temperature notch strength, an aging treatment of above 1450° F. and up to 1500° F. is considered beneficial.

Apart from the foregoing there appears to be an interrelationship between aluminum content and aging temperatures. For example, an aging temperature of 1325° F. together with an aluminum level of about 0.5% does not afford good results whereas quite satisfactory properties are obtained with an aging temperature of 1375° F. at the same percentage of aluminum. Similarly, an aging temperature of 1375° F. plus an aluminum content of 1% is not acceptable in terms of property characteristics; however, satisfactory results follow when the temperature is about 1475° F. or higher. Thus, the aluminum level can be increased above 0.2% and up to at least 1% provided the aging temperature is increased from about 1325° F. and up to about 1475° F. or greater. It is possible that the aluminum content could be raised to levels as high as 1.25%.

When, for reasons of fabrication or otherwise, the higher annealing temperatures are used, e.g., 1900° F. for brazing, an aging temperature over the range of 1375° F. to 1475° F. should be employed in the interests of good rupture strength.

It is believed that by reason of the presence of silicon not only does an excellent combination of tensile and rupture properties obtain, but aging periods can be reduced. This is particularly important, for example, in respect of applications requiring aging in vacuum since such an operation is quite cost sensitive to total aging time. Tables VI, VII, and VIII, infra, reflect that good properties are readily achievable with aging periods of four (4) hours. In siliconfree and low silicon alloys of otherwise comparable chemistry, it does not appear that a similar response is experienced. An aging period of from three (3) to less than eight (8) hours gives satisfactory results.

SECOND COOLING STAGE

While other cooling cycles can be employed subsequent to the initial age, it is preferred to directly cool to the second stage aging temperature. This can be a furnace cool at a rate of, say, about 50° F. to 150° F./hr. We have used a rate of 100° F./hr with highly satisfactory results. As for other cooling treatments, the alloys can be cooled to ambient temperature much in the same manner as the cooling cycle following the annealing stage.

SECOND AGING STAGE

The second aging treatment should be carried out with the temperature range of about 1100° F. to about 1250° F. for a period of about 2 to 12 hours. Temperatures much below 1100° F. tend to increase the time necessary to develop desired properties whereas temperature above 1250° F. result in lowered tensile strength due to insufficient dispersion of fine gamma prime/gamma double prime particles.

The comments with regard to aging time made in connection with the first aging treatment also generally apply to the second stages as well.

FINAL COOLING STAGE

There is no particular substantive reason propertywise which dictates the necessity of applying other than a simple air cooling. Water quenching or furnace cooling could be employed without significantly altering resultant physical and mechanical properties.

ILLUSTRATIVE EMBODIMENTS

In an effort to afford those skilled in the art with a better appreciation of the invention, the following information and data are given:

A 20,000 lb commercial size heat was vacuum induction melted to two 18" dia. electrodes which in turn were vacuum arc remelted to a 20" dia. ingot. The chemistry is reported in Table I. The ingot was homogenized at 2175° F. for 48 hrs and then hot worked to an 8" octagon. A portion of the octagon was heated to 2050° F. and hot rolled to a 1"×4" flat, the finishing step comprising of a 20% reduction at circa 1700° F.

Starting at 1700° F. a series of different annealing temperatures was employed up to 1900° F., variation of 50° F. being used with the time interval being 1 hr followed by an air cool (this minimized possible sensitivity to water quench).

An overall treatment of aging at 1325° F./8 hr, followed by FC 100° F./hr to 1150° F., aging at 1150° F./8 hr and AC was adopted.

Test results (long transverse orientation through the hot rolled flat) are reported in Tables II and III. As can be seen, the as-rolled yield strength was 91 ksi which increased to about 150 ksi after annealing at 1700° F.–1900° F. and aging as described above. Grain size was mixed, elongated ASTM 8. Recrystallization occurred at 1750° F.–1800° F. and grain growth proceeded at 1850° F.–1900° F. (ASTM 2). Room temperature yield and ultimate tensile strength were virtually unaffected over the annealing range in respect of grain size. Tensile ductility decreased at 1850° F.–1900° F.

At 1700° F. plus aging, stress rupture strength and ductility (Table III) were quite good. The combination bar at 140 ksi was notch ductile and had good smooth bar ductility. Raising the annealing temperature to 1750° F. and 1800° F. resulted in higher notch strength but smooth bar ductility and notch ductility fell off. Smooth bar life, ductility and notch bar life ($K_t = 2$) decreased with an annealing temperature of 1900° F.

In Tables IV and V, the initial aging temperature was varied from 1325° F. to 1475° F. (8hrs) using both an 1800° F. and 1900° F. anneal. In essence, the results derived were as indicated above herein, yield and ultimate tensile strength decreased with increasing aging (initial) temperature. Similarly tensile ductility fell off as aging temperature was increased up to 1425° F.

The 1000° F. stress rupture properties developed as follows:

A. 1800° F. Anneal $K_t = 2$ Notch Bar i. only one notch bar failed in the notch section, all other tests having been discontinued or failed in smooth bar ii. the notch tests at 130 ksi were discontinued after 1000 hrs iii. of the notch tests at 145 ksi, one fractured (1325° F. age) in the notch at approximately 100 hrs life iv. tests given higher aging temperatures broke in the smooth ligament Smooth Bar i. rupture strength decreased with increasing aging temperature however, ii. rupture ductility increased Notch Ductility i. a comparison between smooth bar and $K_t = 2$ notch bar life indicates that only the 1325° F. age evidenced signs of notch brittleness ii. the notch bar to smooth bar rupture life ratio markedly increased at aging temperatures above 1325° F.

TABLE I

| CHEMICAL COMPOSITION | | | |
|---|---|---|---|
| Element | Wt. % | Element | Wt. % |
| Si | 0.39 | C | 0.01 |
| Ni | 38.46 | Mn | 0.04 |

TABLE I-continued

| CHEMICAL COMPOSITION | | | |
|---|---|---|---|
| Element | Wt. % | Element | Wt. % |
| Al | 0.05 | Cu | 0.24 |
| Ti | 1.59 | Cr | 0.12 |
| Cb | 4.80 | Mo | 0.12 |
| Co | 13.36 | Fe | Bal* |

*S, B, Ca, P = 0.005% or less.

TABLE II

EFFECT OF ANNEALING TEMPERATURE ON ROOM TEMPERATURE TENSILE PROPERTIES
Product: 1" × 4" flat, hot rolled
Test Orientation: Long Transverse
Anneal: Temp. shown/1 hr/AC
Age: 1325° F./8 hr/FC(100° F./hr); 1150° F./8 hr/AC

| Annealing Temp. °F. | ASTM Grain Size # | 0.2% YS (ksi) | TS (ksi) | El. % | RA % |
|---|---|---|---|---|---|
| As Rolled | 8ME | 91.4 | 140.0 | 36.0 | 52.0 |
| 1700 + Age | 8ME | 148.5 | 189.0 | 14.0 | 33.0 |
| 1750 + Age | 8ME | 150.5 | 190.0 | 15.5 | 34.5 |
| 1800 + Age | 8M | 148.0 | 190.5 | 16.0 | 32.0 |
| 1850 + Age | 5 | 154.0 | 194.5 | 15.0 | 32.5 |
| 1900 + Age | 2 | 155.0 | 192.0 | 12.0 | 17.0 |

NOTE:
M = Mixed ASTM 7-11.
E = Elongated Grain.

TABLE III

EFFECT OF ANNEALING TEMPERATURE ON 1000° F. STRESS RUPTURE
Product: 1" × 4" flat, hot rolled
Test Orientation: Long Transverse
Anneal: Temp. shown/1 hr/AC
Age: 1325° F./8 hr/FC (100° F./hr); 1150° F./8 hr/AC

| | 130 ksi | | | | 140 ksi | | | 145 ksi | | | |
|---|---|---|---|---|---|---|---|---|---|---|---|
| Annealing Temp. °F. | Smooth Life hr | El. % | RA % | $K_t = 2$ Notch Life hr | Comb. Bar Life hr | El. % | RA % | Smooth Life hr | El. % | RA % | $K_t = 2$ Notch Live hr |
| 1700 | 759.2 | 6.5 | 16.5 | D1002.8 | 166.9 | 8.5 | 36 | 102.8 | 9 | 21.5 | D1339.2 |
| 1750 | 1032.9 | 5.0 | 15.5 | D1000.3 | 512.1 | Notch | | 215.9 | 7.5 | 7.5 | D1153.0 |
| 1800 | D1000.3 | — | — | D1153.0 | 240.2 | Notch | | 199.8 | 4.0 | 9.5 | 97.0 |
| 1850 | 329.0 | 0.5 | 6.0 | 39.6 | | | | | | | |
| 1900 | 15.6 | 2.5 | 11.0 | 7.5 | | | | | | | |

NOTES:
D = Discontinued
Combination (Comb.) Bar = Smooth bar and $K_t = 3.6$ Notch bar

TABLE IV

EFFECT OF AGING HEAT TREATMENT ON ROOM TEMPERATURE TENSILE PROPERTIES
Product: 1" × 4" flat, hot rolled
Test Orientation: Long Transverse
Anneal: Temp. shown/1 hr/AC
Age: Temperature shown (°F.)/Time shown (hr) FC (100° F.)/hr) 1150° F./8 hr/AC

| | Anneal °F. | | Age °F./hr | .2% YS (ksi) | TS (ksi) | El. (%) | RA (%) |
|---|---|---|---|---|---|---|---|
| A. | 1800 | + | 1325/8 | 148.0 | 190.5 | 16 | 32 |
| | | | 1350/8 | 145.5 | 187.5 | 17 | 36 |
| | | | 1375/8 | 137.5 | 180.5 | 16.5 | 35.5 |
| | | | 1425/8 | 127.0 | 176.0 | 16 | 28 |
| | | | 1475/8 | 118.0 | 174.5 | 14 | 20 |
| | | | 1425/12 | 120.5 | 172.5 | 16 | 20 |
| B. | 1900 | + | 1325/8 | 155.0 | 192.0 | 12 | 17 |
| | | | 1375/8 | 146.0 | 181.5 | 11.5 | 15 |
| | | | 1425/8 | 132.5 | 178.0 | 11 | 12 |
| | | | 1475/8 | 118.0 | 173.5 | 6 | 6 |
| | | | 1475/16 | 100.0 | 159.0 | 6 | 5.5 |

TABLE V

EFFECT OF AGING TEMPERATURE ON 1000° STRESS RUPTURE PROPERTIES
Product: 1" × 4" flat, hot rolled
Test Orientation: Long Transverse
Anneal: Temp. shown/1 hr/AC
*Age: Temperature shown (°F.)/Time shown (hr)
FC (100° F./hr); 1150°F/8 hr/AC

| | Annealing Time °F. | | Initial Aging Temp./Time* °F./hr | Smooth Bar Life (hr) | El. (%) | RA (%) | $K_t = 2$ Notch Life (hr) | Smooth Bar Life (hr) | El. (%) | RA (%) | $K_t = 2$ Notch Life (hr) |
|---|---|---|---|---|---|---|---|---|---|---|---|
| | | | | At 130 ksi | | | | At 145 ksi | | | |
| A. | 1800 | + | 1325/8 | D1000. | — | — | D1153.(1) | 199.8 | 4 | 9.5 | 97 |
| | | | 1350/8 | 454.7 | 5 | 9.5 | D1050. | 12.3 | 15.5 | 24 | 975.6 S |
| | | | 1375/8 | 277.9 | 4 | 6.5 | D1121. | 4.5 | 17 | 15.5 | 1035.7 S |
| | | | 1425/8 | 160.8 | 9.5 | 21 | D1002. | 4.1 | 24.5 | 46 | 446. S |
| | | | 1475/8 | 23.7 | 18.5 | 31 | D1121. | 0.7 | 23 | 32.5 | 219.6 S |
| | | | 1425/12 | 12.7 | 25 | 37 | D1121. | — | — | — | — |
| | | | | At 120 ksi | | | | | | | |
| B. | 1900 | + | 1325/8 | 100.(2) | NA | NA | 20.9 | | | | |
| | | | 1375/8 | 129 | 2 | 10 | 123.7 | | | | |
| | | | 1425/8 | 133 | 3 | 8.5 | 207.7 | | | | |
| | | | 1475/8 | 695.7 | 2.5 | 7 | D1000.3 | | | | |
| | | | 1475/16 | 38.5 | 6.5 | 10.5 | D1003.2 | | | | |

NOTES:
(1)Comb. bar $K_t$ = 3.6 notch discontinued at 1205.7 hrs.
(2)Estimated from tests at 130 ksi (15-23 hrs).
D = Test discontinued at duration shown
S = Test broke in smooth ligament
NA = Not Available

TABLE VI

EFFECT OF SHORT TIME AGING TREATMENTS ON ROOM TEMPERATURE TENSILE PROPERTIES
Product: 1" × 4" flat, hot rolled
Test Orientation: Long Transverse
Anneal: Temp. shown (°F.)/1 hr/AC
Age: Temperature shown (°F.)/4 hr/FC (100° F./hr); 1150° F./4 hr/AC

| Heat Treatment | | | | | | | |
|---|---|---|---|---|---|---|---|
| | Anneal °F. | | Initial Age °F./hr | .2% YS (ksi) | TS (ksi) | El. (%) | RA (%) |
| A. | 1800 | + | 1325/8(1) | 148 | 190.5 | 16 | 32 |
| | | + | 1325 | 152.5 | 198 | 15.5 | 37.5 |
| | | | 1375 | 142 | 187 | 15.5 | 37 |
| | | | 1400 | 136.5 | 179 | 17 | 38 |
| | | | 1425 | 132.5 | 177 | 17 | 33.5 |
| B. | 1900 | + | 1425/8(1) | 132.5 | 178 | 11 | 12 |
| | | + | 1425 | 137 | 178.5 | 14 | 17 |
| | | | 1475 | 141.5 | 183.5 | 7 | 11.5 |
| | | | 1525 | 139.5 | 182 | 7 | 9.5 |

NOTE:
(1)Comparison ages are 8 hr at temp. shown FC to 1150° F./8 hr/AC.

TABLE VII

EFFECT OF SHORT TIME AGING TREATMENTS ON 1000° F. STRESS RUPTURE PROPERTIES
Product: 1" × 4" flat, hot rolled
Test Orientation: Long Transverse
Anneal: Temp. shown (°F.)/1 hr/AC
Age: Temperature shown (°F.)/4 hr/FC (100° F./hr); 1150° F./4 hr/AC

| Heat Treatment | | | | Smooth Bar | | | |
|---|---|---|---|---|---|---|---|
| | Anneal (°F.) | | Initial Age (°F.) | Life (hr) | El. (%) | RA (%) | $K_t = 2$ Notch Bar Life (hr) |
| | | | | 1000° F./145 ksi | | | |
| A. | 1800 | + | 1325/8(1) | 199.8 | 4 | 9.5 | 97 |
| | | | 1325 | 240.4 | 3 | 8 | 139.1 |
| | | | 1375 | 22.7 | 7 | 10 | 1894.6 S |
| | | | 1400 | 4.7 | 19 | 21 | 736. D |
| | | | 1425 | 3.5 | 24.5 | 44.5 | 866.5 S |
| | | | | 1000° F./120 ksi | | | |
| B. | 1900 | + | 1425/8(1) | 133 | 3 | 8.5 | 207.7 |
| | | | 1425 | 122.1 | 2.5 | 0.5 | 1406.3 |
| | | | 1475 | 133.4 | 1* | 12 | 82.9 |
| | | | 1525 | 122.5 | 1.5 | 11 | 76.6 |

NOTE:
(1)Comparison ages are 8 hr at temp. shown FC to 1150° F./8 hr/AC.
*Broke in punch mark.
S = Fractured in smooth ligament.
D = Discontinued test.

TABLE VIII

COMPARISON OF SHORT TIME AND STANDARD AGES

| | Anneal °F. | Total Aging Time (hr) | Initial Aging Temp. (°F.) | RT Tensile 0.2% YS (ksi) | RT Tensile TS (ksi) | RT Tensile El. (%) | Stress Rupture Test Temp. (°F.) | Stress Rupture Test Stress (ksi) | Smooth Bar Life (hr) | Smooth Bar El. (%) | Smooth Bar RA (%) | Notch Bar $K_t$ | Notch Bar Life (hr) |
|---|---|---|---|---|---|---|---|---|---|---|---|---|---|
| X | 1800 | 10 | 1375 | 142 | 187 | 15 | 1000 | 140 | 270 | 4 | 10 | 2 | >270 |
| | | | | | | | | | | | | 3.6 | >270 |
| | | | | | | | 1200 | 65 | 209 | 28 | 68 | 3.6 | >209 |
| | | 18 | 1325 | 148 | 190 | 16 | 1000 | 140 | 403 | 4 | 5 | 2 | 115 |
| | | | | | | | | | | | | 3.6 | <115 |
| | | | | | | | 1200 | 65 | 209 | 26 | 70 | 3.6 | >209 |
| Y | 1900 | 11 | 1425 | 137 | 178 | 14 | 1000 | 120 | 122 | 3 | 8.5 | 2 | 1406 |
| | | 19 | 1425 | 132 | 178 | 11 | 1000 | 120 | 133 | 2.5 | .5 | 2 | 207 |

B. 1900° F. Anneal $K_t = 2$ Notch Bar notch bar life at 1000° F./120 ksi increased as aging temperature was raised Smooth Bar In contrast with the results given for the 1800° F. anneal, smooth bar rupture life increased with aging temperature. While the explanation for this unexpected behavior is not fully understood at present, it is thought there is an increased sensitivity by reason of a course grained structure to the mechanism of stress accelerated grain boundary oxygen embrittlement. But it should be mentioned that smooth bar, as in the case of notched bars, can be affected by machining marks, alignment, etc. Overaging tends to lessen the sensitivity to such factors.

Tables VI and VII reflect the effect of short time aging treatments, 4 hours, after both 1800° F. and 1900° F. annealing temperatures, the aging temperatures being varied as in Table VI. Table VIII offers a comparison of total heat treating periods, i.e., the shorter cycle (10 hours) versus the longer cycle (18 hours). As can be seen, satisfactory properties can be attained with the shorter duration heat treating cycles. It might be added that the 1800° F./1 hr, AC, age 1375° F./4 hr, FC to 1150° F./4 hr, AC gave good notch ductility with a $K_t = 3.6$ combination bar.

Although the present invention has been described in conjunction with preferred embodiments, it is to be understood that modifications and variations may be resorted to without departing from the spirit and scope of the invention, as those skilled in the art will readily understand. Such modifications and variations are considered to be within the purview and scope of the invention and appended claims. It might be added that a preferred silicon range is from 0.3 to 0.6%. The carbon level can be extended up to about 0.12% and, as indicated above herein, the aluminum content can range from above 0.2 and up to 1.25%. The disclosure of our parent application is incorporated by reference. The range of a given constituent of the subject alloys can be used together with the ranges of the other constituents. Similarly, a specific heat treating range can be used with other heat treating parameters.

We claim:

1. A process for heat treating age hardenable, nickel-iron and nickel-cobalt-iron alloys, the alloys consisting essentially of about 34% to 55% nickel, up to 25% cobalt, about 1% to about 2% titanium, about 1.5% to about 5.5% columbium, about 0.25% to 1% silicon, up to about 1.25% aluminum, up to about 0.01% boron, up to 0.1% carbon, the balance essentially iron, said alloys when balanced in composition in accordance with $$A = (\%Ni) + 0.93(9\%\ Co) - 1.46(\%Ti) + 0.54\ (\%Si\%Cr) + 1.37\ (\%Mn + \%Cu) + 7.04\ (\%C)\ \text{At most } 52.9$$

$$B = (\%Ni) + 0.97\ (\%Co) - 1.15\ (\%Ti) - 1.21\ (\%Si + \%Cr) + 9.35(\%C)\ \text{At least } 43.6$$

exhibit in the age-hardened condition an Inflection Temperature of at least 625° F. and a Coefficient of Expansion no greater than $5.5 \times 10^{-6}$ *per° F. between ambient temperature and* 780° which comprises (i) annealing the alloys at a temperature from about 1700° F. to about 1900° F. for a period of up to about 9 hours depending upon section size, (ii) cooling the alloy, (iii) aging the alloy at a temperature of from about 1300° F. to about 1500° F. for up to about 12 hours, depending upon section size, (iv) cooling the alloy to a second aging temperature, (v) aging at a temperature of about 1100° F. to about 1250° F. for up to 12 hours, and (vi) cooling the alloy to ambient temperature, said heat treatment being characterized in that the initial aging temperature of 1300° F. to 1500° F. and aluminum content are correlated such that as the aluminum content is increased above about 0.2% aging temperature is also increased within the said temperature range of 1300° F. to 1500° F.

2. The process of claim 1 wherein the alloy heat treated consists essentially of about 35% to about 39% nickel, about 12% to about 16% cobalt, about 1.2% to about 1.8% titanium, about 4.3% to about 5.2% columbium, about 0.3% to about 0.6% silicon, up to about 0.1% aluminum, up to about 0.1% carbon, the balance being essentially iron.

3. The process of claim 1 wherein the respective aging treatments are carried out for periods of less than about 8 hours.

4. The process of claim 3 wherein the respective aging treatments are carried out for periods of at least 3 hours.

5. An alloy characterized in the age-hardened condition by controlled expansion properties with an inflection temperature of at least 625° F. and a coefficient of expansion between ambient temperature and 780° F. of $5.5 \times 10^{-6}$ per ° F. or less, high strength and good notch rupture strength consisting essentially of about 34% to 55% nickel, up to about 25% cobalt, about 1% to 2% titanium, about 1.5% to 5.5% columbium, about 0.25% to 1% silicon, from above 0.2% and up to 1.25% aluminum, up to about 0.12% carbon and the balance essentially iron said alloy being balance in composition to satisfy the following formulae $$A = (\%Ni) + .93(\%Co) - 1.46(\%Ti) + .54\ (\%Si + \%Cr) + 1.37\ (\%Mn + \%Cu) + 7.04\ (\%C)\ \text{At most } 52.9$$

$$B = (\%Ni) + .97\ (\%Co) - 1.15\ (\%Ti) - 1.21\ (\%Si - \%Cr) - 9.35(\%C)\ \text{At least } 43.6$$

said alloy being further characterized is that it has been heat treated in accordance with the heat treatment set forth in claim 1.

6. An alloy in accordance with claim 5 in which the silicon content is 0.3% to 0.6%.

* * * * *